US005595538A

United States Patent [19]

Haste, III

[11] Patent Number: 5,595,538

[45] **Date of Patent: *Jan. 21, 1997**

[54] ELECTRONIC GAMING MACHINE AND METHOD

[76] Inventor: Thomas E. Haste, III, 11258 Ventura Blvd. #734, Studio City, Calif. 91604

[ * ] Notice: The term of this patent shall not extend beyond the expiration date of Pat. No. 5,580,311.

[21] Appl. No.: 552,221

[22] Filed: Nov. 2, 1995

Related U.S. Application Data

[63] Continuation-in-part of Ser. No. 406,024, Mar. 17, 1995.

[51] Int. Cl.[6] ..... A63F 1/18

[52] U.S. Cl. ..... 463/17; 463/29; 273/139

[58] Field of Search ..... 463/16–18, 20, 463/29; 273/138 R, 139; 283/49, 70, 901, 903; 364/410–412; 235/375; 221/1, 2, 24

[56] References Cited

U.S. PATENT DOCUMENTS

| | | | |
|---|---|---|---|
| 4,689,742 | 8/1987 | Troy et al. | 463/18 |
| 4,725,079 | 2/1988 | Koza et al. | 273/139 |
| 4,774,571 | 9/1988 | Mehdipour et al. | 364/467 |
| 4,842,278 | 6/1989 | Markowicz | 463/18 |
| 4,982,337 | 1/1991 | Burr et al. . | |
| 5,039,848 | 8/1991 | Stoken . | |
| 5,088,737 | 2/1992 | Frank et al. | 463/18 |
| 5,222,624 | 6/1993 | Burr . | |
| 5,317,135 | 5/1994 | Finocchio | 364/412 |
| 5,348,299 | 9/1994 | Clapper | 463/16 |
| 5,377,975 | 1/1995 | Clapper | 463/17 |
| 5,499,816 | 3/1996 | Levy | 273/139 |
| 5,507,491 | 4/1996 | Gatto et al. | 273/139 |

*Primary Examiner*—Jessica Harrison
*Assistant Examiner*—Mark A. Sager
*Attorney, Agent, or Firm*—Blakely, Sokoloff, Taylor & Zafman, LLP

[57] ABSTRACT

A gaming machine for dispensing game tickets imprinted with a message indicating whether the player has won or lost. A ticket supply, such as a continuous roll of tickets, is installed in the machine. The ticket includes a ticket identifier in the form of a machine-readable identifier encoded onto each physical ticket. The ticket identifier corresponds to a stored record which includes a combination of indicia. The ticket is dispensed and its indicia data, as obtained from a memory module, are displayed on a screen. Winning combinations of indicia are detected electronically and used activating a winner light on the machine. Because the indicia are neither printed nor encoded onto the exterior of the ticket, the locations of winning tickets cannot be determined in advance of ticket purchase.

14 Claims, 7 Drawing Sheets

ELECTRONIC GAMING MACHINE AND METHOD

RELATED APPLICATION

This application is a continuation-in-part of a U.S. patent application Ser. No. 08/406,024, filed Mar. 17, 1995, entitled, "Electronic Gaming Machine and Method."

BACKGROUND OF THE INVENTION

This invention relates generally to gaming apparatus and, more particularly, to apparatus for dispensing game coupons used in a game of chance. An example of such a game is one often known as "pull tab." A conventional pull-tab game is played in gaming establishments using a large number of cards or game tickets, which are dealt from a box upon payment of purchase price. Each game ticket bears a number of symbols or indicia, covered by a removable tab or a coating that can be scratched off. Some of the cards bear winning combinations of indicia, and these may be presented by the purchasers to redeem prizes.

Various attempts have been made to mechanize the pull-tab game, such that it can be played using an automated coupon dispensing machine. For example, U.S. Pat. No. 5,348,299 issued to Ronald C. Clapper, Jr. discloses and claims a machine of this general type.

A desirable attribute of such machines is that they should outwardly resemble gaming machines of the type known as "slot machines," "slots," or "one-armed bandits." In using these conventional slot machines, a player deposits a coin or token and activates the machine, either by pulling a lever, in the case of an electromechanical machine, or simply pressing a button, in the case of a fully electronic machine. The machine presents the player with a matrix of symbols or indicia, which change rapidly for a few seconds after activation, and then presents a final display, which may contain a winning combination. The winning combination usually requires the horizontal or other alignment of symbols of the same type. When this happens, the machine "pays off" by automatically dispensing prize money in the form of coins, or by activating a winner light or audible signal. These gaming machines are, of course, extremely popular in casinos and other gaming establishments. However, in some jurisdictions, machines of this type are illegal, although pull-tab games are not. Therefore, there has been a movement toward pull-tab machines that have an appearance similar to the more popular slot machines. The machine disclosed in the Clapper, Jr. patent presents an electronic three-by-three matrix display of symbols similar to those used in conventional slot machines. However, the matrix display is not randomly generated when the machine is activated. Instead, the display is generated to duplicate the pattern on a pull-tab coupon that is dispensed from the machine each time it is played. The coupons in the Clapper, Jr. system are dispensed from a large roll of coupons stored inside the machine. The roll contains duplicate strips, one of which is retained in the machine for subsequent auditing purposes, and other of which is cut into dispensed coupons. On the back of one of the strips is a machine readable bar code indicating which symbols or indicia are on each coupon. Before the coupon is distributed to the player, the bar code is read by an optical scanner and the same symbols that appear on the coupon are displayed on the matrix display of the machine. Thus, the machine retains some of the allure of a conventional slot machine, but still qualifies as a pull-tab game under regulations governing the use of gaming machines.

A cumbersome aspect of these games is that for each separate game, a roll of tickets must be printed with a variety of indicia, each with the specific combination. Moreover, if the electronic memory is replaced to run a different game, utilizing other indicia, different ticket rolls, specific to that game, must also be installed. Therefore, there is a need to simplify the tickets used so as to reduce operating costs, and streamline the operating procedures. The subject invention satisfies this need.

SUMMARY OF THE INVENTION

The present invention resides in an electronic gaming machine and a method for its use. Briefly, and in general terms, the gaming machine of the invention comprises a payment acceptance device, for receiving payment from a player wishing to use the gaming machine; a supply of game tickets installed in the gaming machine; and a game ticket dispenser for dispensing game tickets one at a time from the supply of tickets. Each ticket includes indicia imprinted thereon, and a machine-readable identifier uniquely identifying the ticket. The machine further comprises a ticket reader, for reading the identifier on each ticket before it is dispensed, and a game controller, responsive to acceptance of payment. The game controller obtains from a memory module a stored ticket record corresponding to the ticket identifier and a combination of indicia specific to the ticket identifier. The gaming machine also includes a display device, for displaying the combination of indicia related to a dispensed ticket, the indicia being obtained from the electronic memory module.

The game controller may also include means for determining whether the ticket being dispensed relates to a winning combination of indicia. When a winning combination of indicia is detected, a winner light or other similar device on the machine is actuated by the game controller. The machine further comprises an electronic memory module in which are stored ticket records corresponding to the tickets in the ticket supply, each ticket record including codes corresponding to the ticket identifier and a combination of indicia specific to the ticket identifier. The functions of the controller include reading a next sequential ticket record from the memory module, comparing the ticket identifier read from the memory module with the ticket identifier read by the ticket reader, if the ticket identifiers match, actuating the game ticket dispenser to dispense the ticket. Once the ticket is dispensed, the corresponding ticket record may be erased from the memory module.

In a preferred embodiment of the invention, the ticket supply is a continuous roll of tickets, and the game ticket dispenser includes a ticket cutter. The machine-readable ticket identifiers are imprinted on the tickets in the form of bar codes, and the ticket reader includes a bar-code scanner. Preferably, the machine-readable ticket identifiers are encrypted for further improved security.

The invention may also be defined as a method operation of an electronic gaming machine, comprising the steps of determining whether payment has been made to purchase a gaming ticket from the machine; determining whether a play control has been activated to initiate operation of the machine; and, when payment has been made and play initiated, reading a next ticket record from an electronic memory module installed in the machine and having ticket records corresponding to tickets in a ticket supply installed in the machine. Each ticket record includes a ticket identifier and a plurality of indicia. The tickets are imprinted with indicia that indicate whether the related stored indicia are a winning or losing combination. The indicia may be statements or symbols. The method may also include the step of displaying on a screen the indicia obtained from the ticket record read from the electronic memory module, this step being performed at about the same time as the dispensing step. The method may also includes the steps of determining whether the indicia obtained from the ticket record is a winning combination, and actuating a winner indicator on the machine if a winning combination of indicia is detected.

Further steps of the method may include reading a ticket identifier from a next ticket in the ticket supply; comparing the ticket identifier read from the next ticket with the ticket identifier from the next ticket record read from the electronic memory module, to validate the ticket; and, if the comparing step results in a match, dispensing the next ticket from the ticket supply and erasing the corresponding ticket record in the memory module.

It will be appreciated from the foregoing that the present invention represents a significant advance in the field of gaming machines. In particular, the invention provides a high level of security because the indicia are neither imprinted nor encoded on the exterior surfaces of the tickets. Moreover, as the tickets are only imprinted with indicia regarding whether or not the related stored combination of indicia is a winning or losing combination, the costs of producing these ticket rolls, and thus the costs of operating these gaming machines is less, and the process of changing the gaming program is simplified. Other aspects and advantages of the invention will become apparent from the following more detailed description, taken in conjunction with the accompanying drawings.

BRIEF DESCRIPTION OF THE DRAWINGS

FIGS. *5a* and *5b* are front and rear views of a portion of a roll of a first type of game tickets used in the gaming machine of the invention.

DETAILED DESCRIPTION OF THE INVENTION

Figure 1:
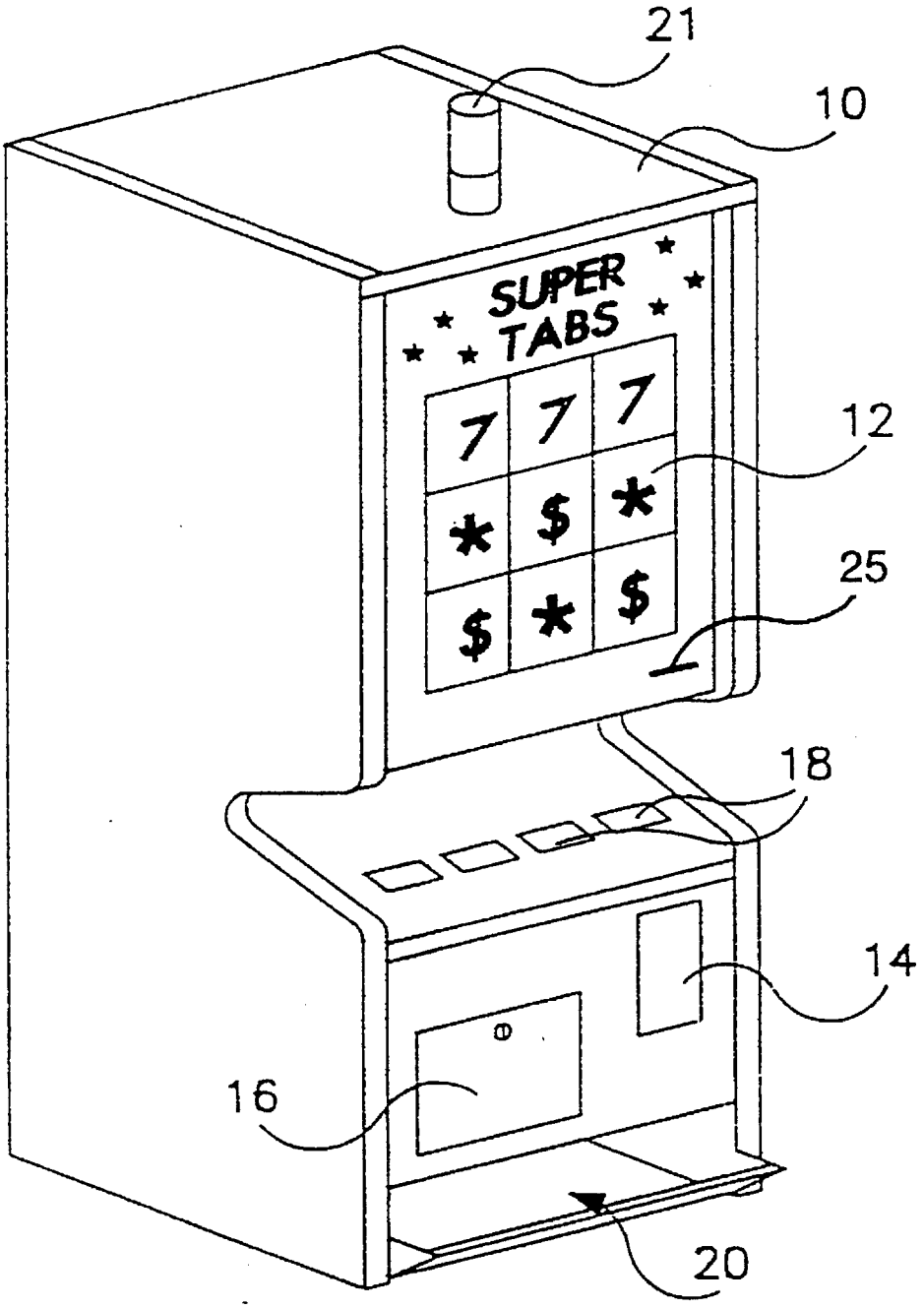
FIG. 1 is simplified perspective view of a gaming machine in accordance with the present invention.

As shown in the drawings for purposes of illustration, the present invent pertains to a gaming machine. One example of such a machine is the "pull-tab" type, which dispenses game tickets having a removable cover or coating. Upon removal of the ticket cover or coating, imprinted symbols or indicia on the ticket are revealed to a purchaser of the ticket. Only a small number of preselected tickets bear a winning combination of symbols.

In machines of this type that have previously been proposed, there is little to prevent an unscrupulous owner or operator of such a machine from scanning a roll of game tickets prior to installing it in a machine for public use, and thereby determining the locations of winning tickets on the roll. In accordance with the present invention, a pull-tab gaming machine is provided with security features that preclude an owner or operator of the machine from locating the winning tickets. In machines of the prior art, each ticket included a bar-coded form of the indicia. The ticket was scanned by a bar-code scanner and the information obtained was used to display the indicia on a video display device. In the subject invention, the indicia on each ticket are not encoded on the ticket, so the winning tickets cannot be identified by scanning the tickets. Moreover, because the indicia are printed under a cover strip on each ticket, winning tickets cannot be identified by simply viewing the ticket roll.

More specifically, FIG. 1 shows a gaming machine in which the subject invention may be installed. The machine includes a sturdy housing, indicated by reference numeral 10, preferably of steel or similar material, a video display 12 for displaying "reel" information, analogous to the way electromechanical slot machines display rotatable reels on which symbols or indicia are imprinted. The video display 12 is also used to display player credits and other information. The machine also includes a cash or bill acceptor 14, a cash box 16 and a set of play buttons 18. At the bottom of the machine is a ticket dispenser tray 20, and on top of the machine is winner light 21, which alerts players and others that a winning ticket has been purchased.

Figure 2:
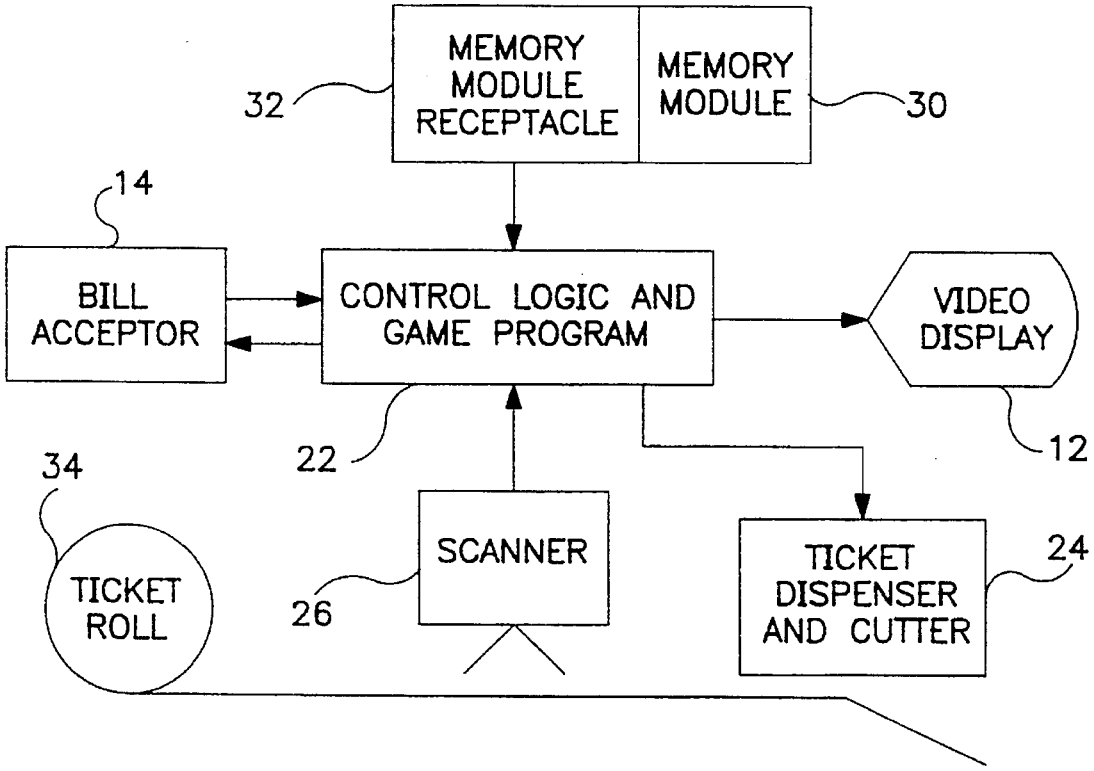
FIG. 2 is a block diagram depicting the principal components of the gaming machine of the invention.

FIG. 2 shows the principal components of the gaming machine of the invention. Control logic and a gaming program 22 control operation of the machine in a relatively straightforward manner, as will be further described below. The logic 22 controls the video display 12 and the bill acceptor 14, as well as a ticket dispenser and cutter 24 and a ticket scanner 26. An additional feature of the subject invention is an electronic memory module 30, which plugs into a memory module receptacle 32, which in turn is electrically connected to the control logic 22.

The memory module 30 contains a record of data for each game ticket on a roll of tickets 34. Each ticket record contain the following data: (1) an encoded form of the ticket indicia printed on the ticket, (2) a ticket number identifying the sequential position of the ticket, (3) a roll number identifying a specific ticket roll 34, and (4) a deal number identifying a ticket "deal." A deal is a database of winning and losing tickets. Depending on local legislation covering operation of the machine, a deal could encompass a single roll or multiple rolls of tickets. Various gaming regulation schemes require there to be a certain number of winning tickets in a deal of specified size. The memory module 30 in the presently preferred embodiment of the invention is a flash memory that is both programmable and non-volatile, i.e. the contents of the memory are preserved even when electrical power is not supplied to the module. The module is preferably highly tamper-proof. Any attempt to read, copy or modify the contents of the module renders it inoperative for purposes of the gaming machine.

Unlike electronic pull-tab machines of the prior art, the machine of the subject invention is not solely controlled by the indicia encoded onto the game tickets. The only information encoded on each ticket is its identifying data, including the ticket number, roll number and deal number. It will be understood, of course, that other forms of ticket identifying data could be used for purposes of the subject invention. When a new ticket is purchased, the identifying data is scanned into the control logic and the next ticket record in sequence is read from the memory module 30. The ticket data is then compared with corresponding information obtained from the memory module 30. If the ticket number, roll number and deal number read from the ticket are the same as the corresponding numbers read from the memory module 30, the ticket is deemed to be valid and is dispensed from the machine. The corresponding ticket record in the memory module 30 is then erased, to preclude the possibility of tampering by reading the memory module a second time. At about the same time that the ticket is dispensed, the indicia information retrieved from the memory module 30 is displayed in the video display 12 for the convenience of the game player. The player can then view the contents of the ticket without having to remove the cover from the purchased ticket.

The game logic also determines whether the ticket contains a winning combination of indicia. This win-lose result may be also stored in the memory module 30, or the game logic may determine from internally stored game rules whether the combination of indicia is a winning one or not. In the case of a winning ticket, the game logic 22 may activate the winner light 21 on the machine to alert the player or an attendant that a winning ticket has been purchased.

Figure 3:
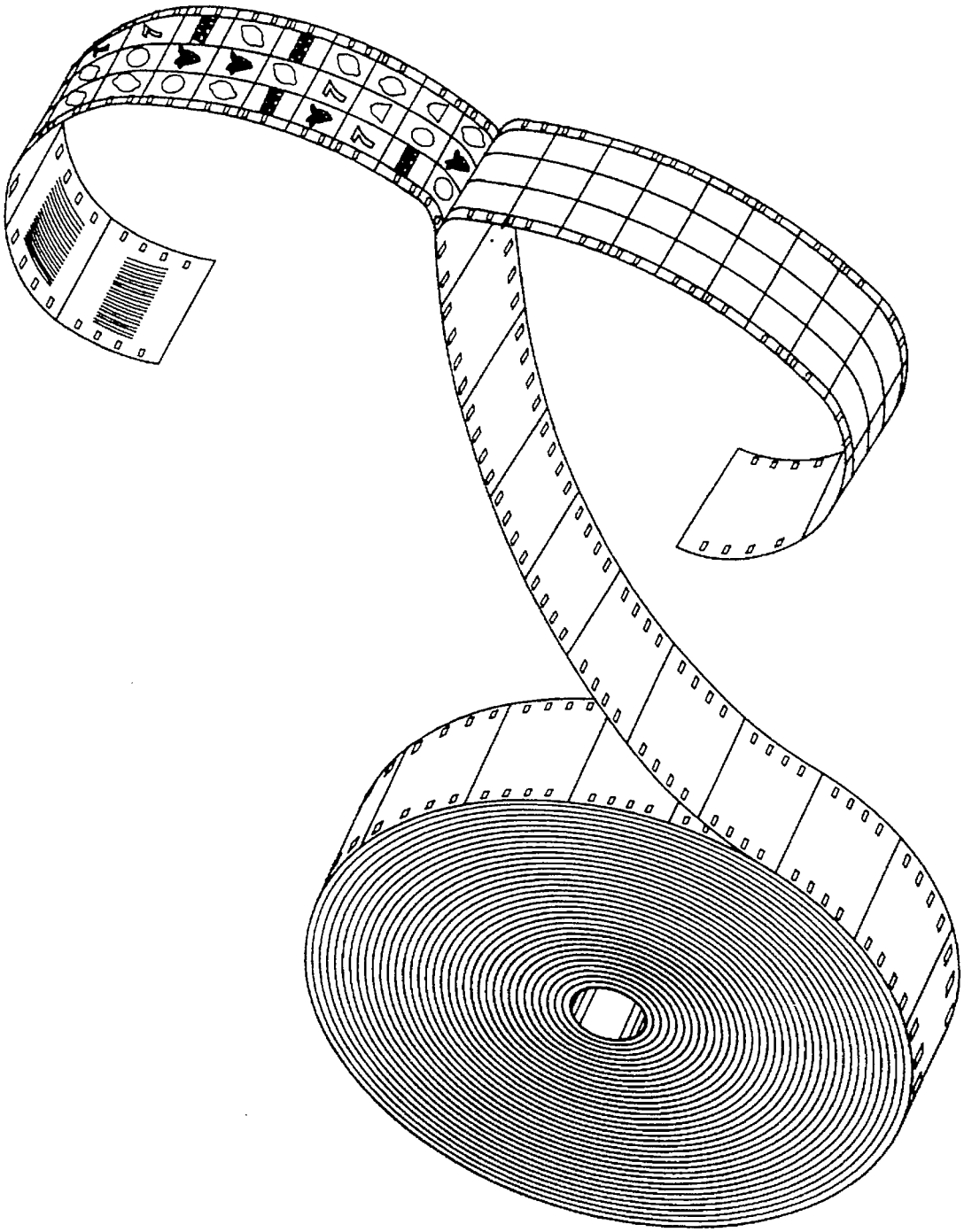
FIG. 3 is a perspective view of a roll of game tickets.

As shown in FIG. 3, each roll 34 of tickets is imprinted with indicia or symbols used in the game. Typically each ticket contains nine such indicia and a winning combination requires the alignment of two or three similar or related indicia in a single horizontal, vertical or, in some cases, diagonal row. As illustrated, each ticket includes a cover strip that renders the indicia invisible prior to removal of the cover strip. The cover strip may take the form of an adhesive film removable by simply peeling it off, an opaque coating removable by scratching, or other forms of opaque covering.

Figure 5A:
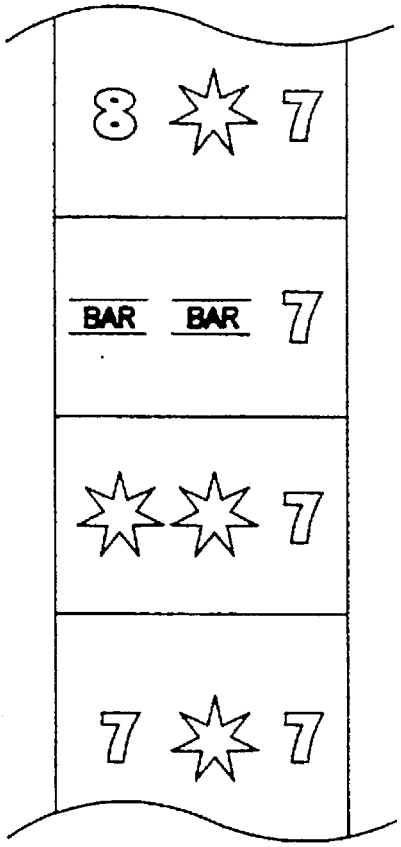
Figure 5B:
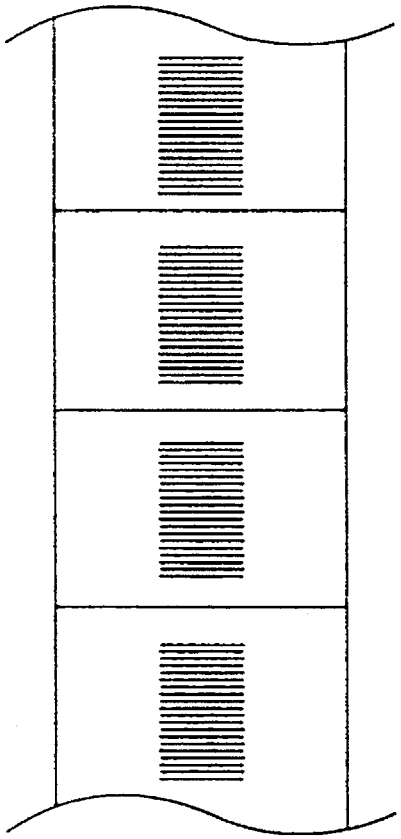

As also shown in FIG. 5, each ticket on the roll 34 also has imprinted bar codes on an exterior surface of the ticket, such that the bar codes can be scanned without removing the cover strip from the ticket. As mentioned earlier, the bar codes contain no information concerning the indicia imprinted on the ticket, but only ticket number, roll number and deal number information. For additional security, the bar codes are preferably encrypted in some manner to prevent even this information from being easily obtained by someone without knowledge of the type of encryption used. Even if the bar codes were read by an unauthorized person, they would be of no use in determining the location of winning tickets on the roll 34.

Figure 4:
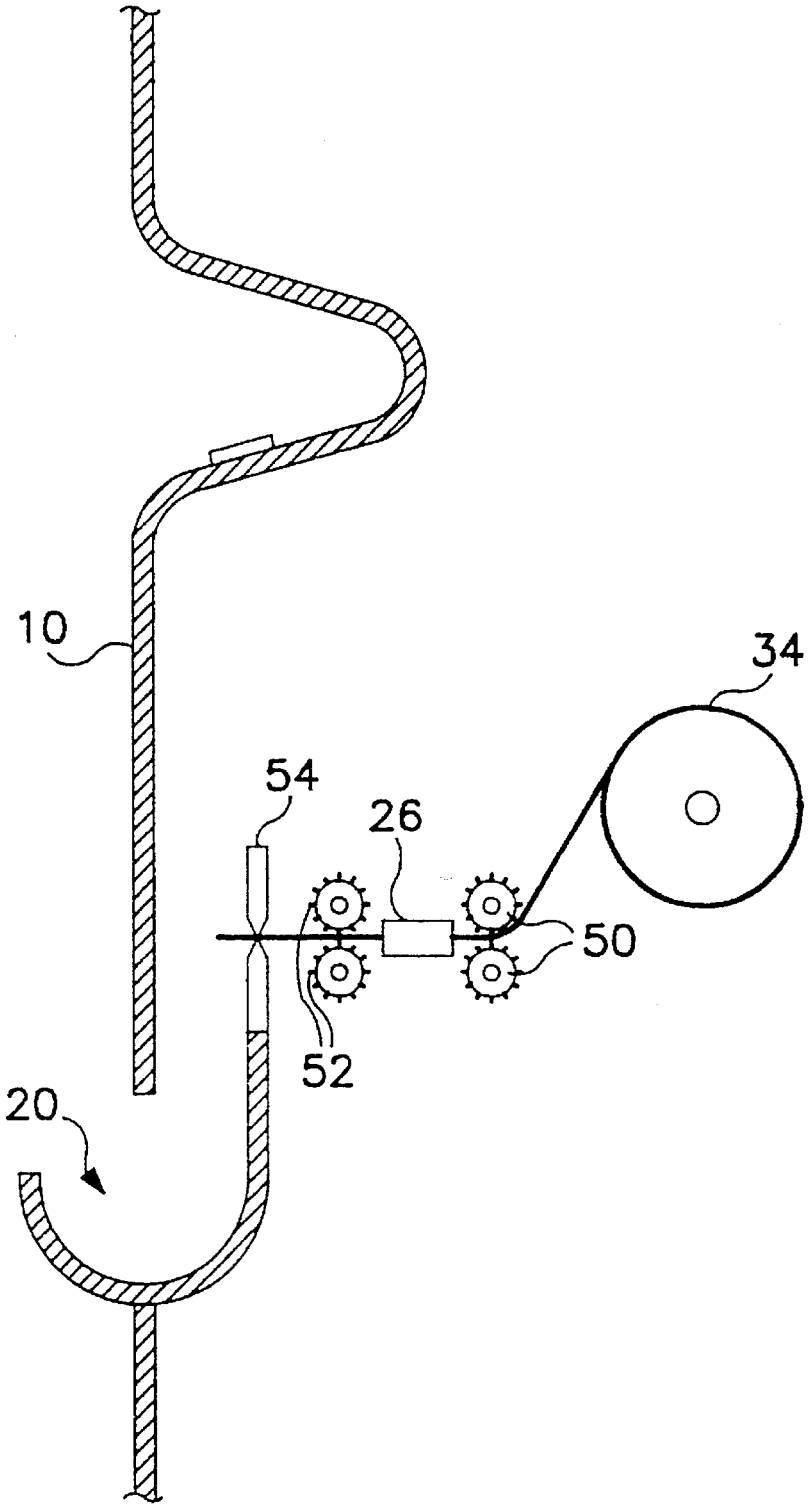
FIG. 4 is fragmentary elevation view, partly in section, showing ticket dispensing and scanning components of the gaming machine.

FIG. 4 shows the tape dispensing mechanism in more detail, including two pairs of feeder wheels 50 and 52 arranged on each side of the scanner 26, a ticket cutter 54, shown in relation to the housing 10 and the tab dispenser tray 20.

Figure 6:
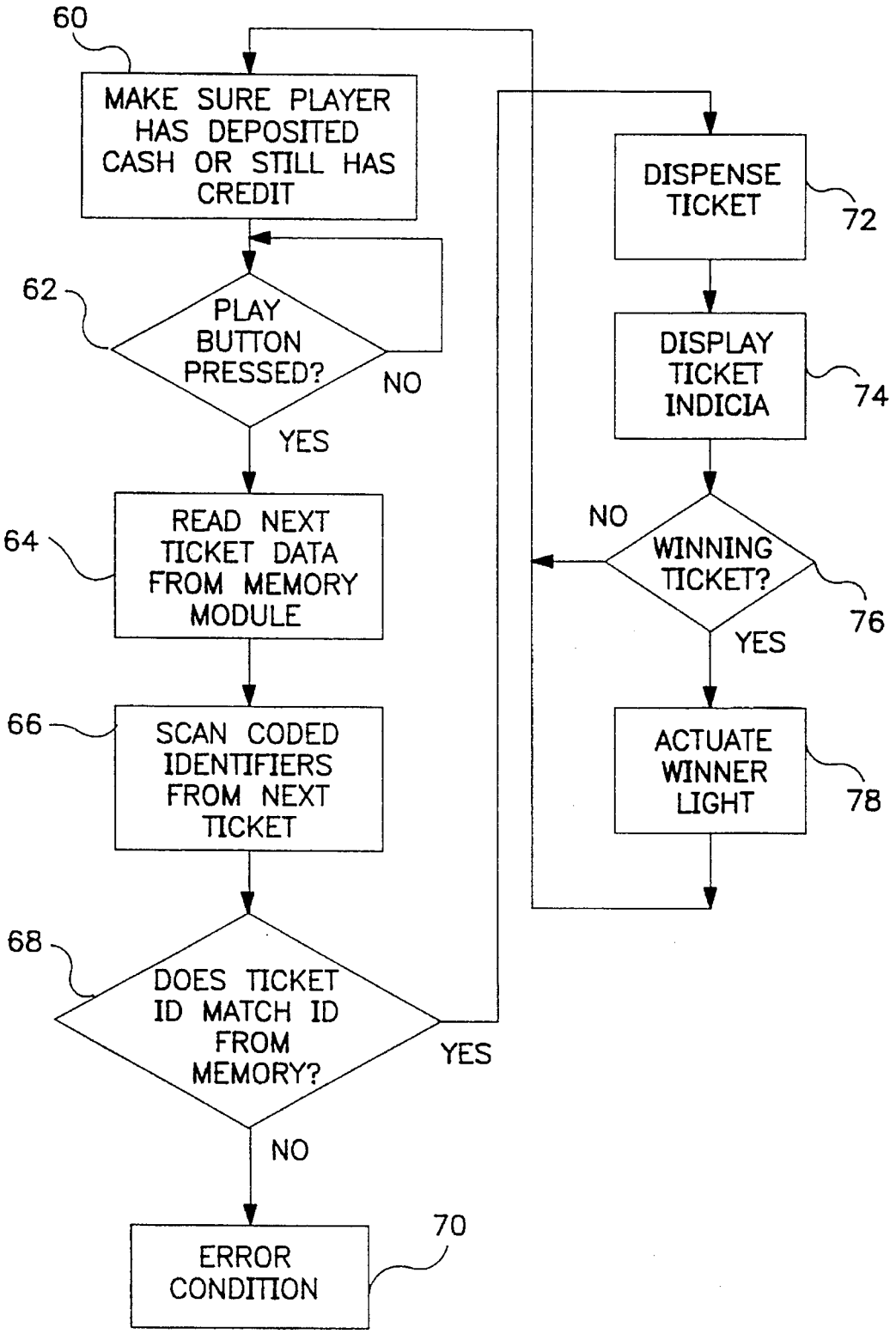
FIG. 6 is a flowchart showing the principal functions performed by the control logic of FIG. 2.

The principal functions performed by the control logic 22 (FIG. 2) are shown in the flowchart of FIG. 6. When the gaming machine is waiting to be activated, its principal function is to check for deposit of a coin or bill into the machine, as indicated in block 60. Once a deposit has been made, or credit remains from a prior play of the machine, the logic checks repeatedly for actuation of a "play" button on the machine, as indicated in decision block 62. Once a play has been initiated, the logic initiates reading of the next ticket image from the memory module 30, as indicated in block 64, and scans the coded ticket identifying data from the next ticket in the roll 34, as indicated in block 66. Then the ticket identifier from the memory module is compared with the identifier scanned from the ticket itself, as indicated in decision block 68. If the identifiers do not match, an error condition exists, as indicated in block 70, and operation of the machine would normally be terminated.

If the identifying data on the ticket matches the data retrieved from the memory module 30, the control logic 22 dispenses the ticket, as indicated in block 72, displays the indicia derived from the electronic ticket record, as indicated in block 74 and determines whether the ticket is a winning one, as indicated in decision block 76. If a winning ticket is indicated, the winner light is activated, as indicated in block 78, and other action may be taken before returning to block 60 and waiting for the next play to be initiated.

Figure 7:
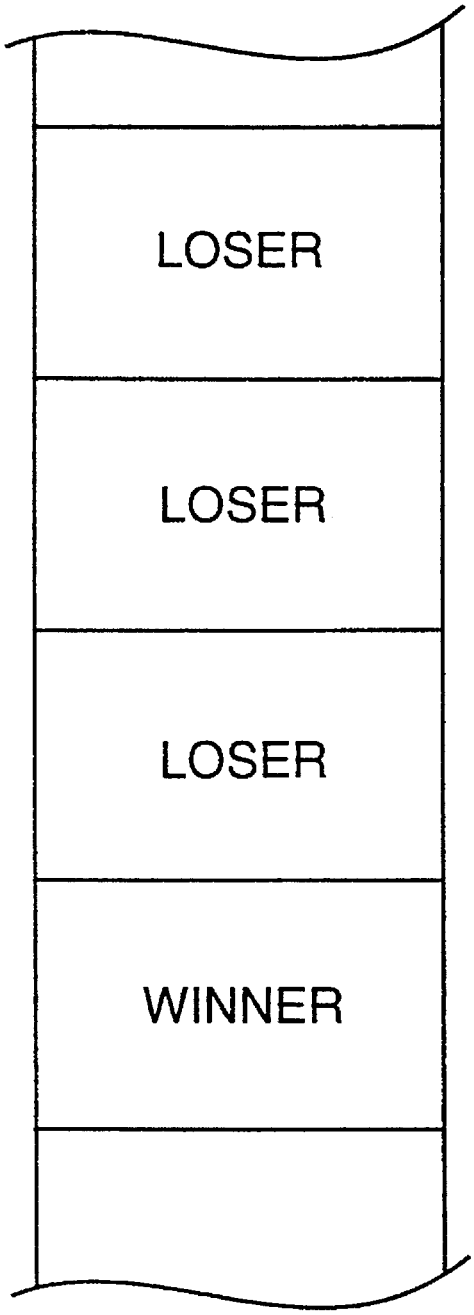
FIG. 7 is a front view of a portion of a roll of a second type of game tickets used in the gaming machine of the invention.

In another embodiment of the invention, each ticket as shown in FIG. 7 is imprinted with indicia that indicates whether the related stored indicia are a winning or losing combination, rather than the related indicia in the ticket record. The indicia may be, for example, statements such as "LOSER" or "WINNER" or the indicia may be dollar amounts, or other symbols. The ticket is also encoded with a ticket identifier. Upon activation, the subject invention reads each record of ticket indicia from the memory module 30. The control logic 22 dispenses the ticket, as indicated in block 72, and displays the indicia derived from the electronic ticket record, as indicated in block 74.

The gaming machine may include a means for inserting the ticket after it has been dispensed which includes a ticket reader 25. The ticket reader 25 reads the encoded ticket identifier and obtains the related stored indicia. The information is then processed to display the related indicia.

It will be appreciated from the foregoing that the subject invention represents a significant advance in the field of gaming machines. In particular, the invention provides an electronic gaming machine with security features that effectively preclude unauthorized detection of winning tickets in a roll of tickets dispensed from the machine and simplifies the operating costs and procedures of such machines.

In particular, although each ticket is scanned in the machine as it is dispensed, and the indicia related to the ticket are displayed on a display device, it is impossible to determine which indicia are related to the ticket without scanning the information from the memory module of game controller. The indicia, which may be printed inside the ticket, are not encoded on the ticket at all, but encoded instead in the memory module, which is accessed whenever a play is initiated and a ticket record is read. Ticket identifying data are scanned on the ticket and the displayed indicia are derived from the memory module rather than from information encoded on the ticket. Since the roll of tickets cannot be scanned to determine locations of winning tickets, the gaming machine has a high level of security, but still operates in somewhat the same manner as a convention slot machine.

It will also be appreciated that the simplified tickets, which will indicate either winner or loser but not include the specific indicia, significantly reduce the printing costs of the tickets, and thus the costs for operating the machines. Moreover, in many instances, an operator of the gaming machines will only need to replace the software which drives the modules, rather than ticket rolls as well, since the ticket are not specific to a particular game.

It will also be appreciated that, although a specific embodiment of the invention has been described in detail by way of example, various modifications may be made without departing from the spirit and scope of the invention, which should not be limited except as by the accompanying claims.

I claim:

1. An electronic gaming machine, comprising:

a payment acceptance device, for accepting payment from a player;

a supply of tickets installed inside the gaming machine, wherein each ticket includes first indicia imprinted thereon, and each ticket further includes a machine-readable identifier, uniquely identifying the ticket;

a ticket dispenser for dispensing tickets one at a time from the supply of tickets;

a ticket reader, for reading the identifier on each ticket before such ticket is dispensed;

a display device;

a game controller for receiving the identifier read by the ticket reader and, in response thereto, for sending data representative of second indicia specific to each ticket to the display device, wherein said second indicia is different from said first indicia.

2. An electronic gaming machine as defined in claim 1, wherein:

the game controller further includes means for determining whether the ticket being dispensed includes first indicia indicating a winning ticket; and the machine further comprises a winner light actuated by the game controller if a winning ticket has been dispensed.

3. An electronic gaming machine as defined in claim 1, wherein:

each ticket has a removable cover over the first indicia.

4. An electronic gaming machine as defined in claim 1, and further comprising:

an electronic memory module in which are stored ticket records corresponding to the tickets in the ticket supply, each ticket record including codes corresponding to the identifier and second indicia specific to each ticket;

wherein the game controller reads from the memory module a ticket record corresponding to a next ticket in the ticket supply, compares the identifier read from the memory module with the identifier read by the ticket reader and, if the identifiers match, actuates the ticket dispenser to dispense said next ticket.

5. An electronic gaming machine, as defined in claim 4, wherein:

the gaming device has a slot in which a dispensed ticket is inserted; and further comprising;

an electronic reader for reading the identifier on the dispensed ticket and activating the game controller to obtain the code corresponding to the second indicia for the dispensed ticket and output said code corresponding to the second indicia to the display device.

6. An electronic gaming machine as defined in claim 1, wherein:

the ticket supply is a continuous roll of tickets; and the ticket dispenser includes a ticket cutter.

7. An electronic gaming machine as defined in claim 6, wherein:

the machine-readable ticket identifiers are imprinted on the tickets in the form of bar codes; and the ticket reader includes a bar-code scanner.

8. An electronic gaming machine as defined in claim 7, wherein:

the machine-readable identifiers are encrypted for further security.

9. An electronic gaming machine as defined in claim 8, wherein:

the ticket supply is a continuous roll of tickets; and each ticket identifier includes a ticket number, a roll number and a deal number, wherein a deal includes one or more rolls of tickets.

10. An electronic gaming machine, comprising:

a payment acceptance device, for accepting payment from a player;

a supply of tickets installed inside the gaming machine, wherein each ticket includes a first indicia imprinted thereon and each ticket further includes a machine-readable identifier uniquely identifying the ticket;

a ticket dispenser for dispensing tickets one at a time;

an electronic memory module in which are stored ticket records corresponding to the tickets, each ticket record including codes corresponding to the identifier and second indicia specific to the identifier, wherein said second indicia is different from said first indicia;

a ticket reader, for reading the identifier on each ticket before such ticket is dispensed;

a video display device for displaying the second indicia corresponding to a ticket when it is dispensed; and a game controller for reading a next sequential ticket record from the memory module, comparing the identifier read from the memory module with the identifier read by the ticket reader and, if the identifiers match, actuating the ticket dispenser to dispense the ticket, erasing from the memory module the ticket record of the dispensed ticket, displaying the corresponding second indicia as read from the memory module, and actuating a winner light if the second indicia include a winning combination.

11. A method of operation of an electronic gaming machine having a supply of tickets, comprising the steps of:

determining whether payment has been made to purchase a ticket from the machine;

determining whether a play control has been activated to initiate operation of the machine;

reading a ticket identifier from a next ticket in the ticket supply;

dispensing the next ticket from the ticket supply;

obtaining from a memory module a ticket record corresponding to the next ticket including the ticket identifier and ticket indicia; and displaying on a screen the ticket indicia obtained from the ticket record.

12. A method as defined in claim 11, and further comprising the steps of:

determining whether the ticket indicia obtained from the ticket record include a winning combination; and actuating a winner indicator on the machine if a winning combination of ticket indicia is detected.

13. A method as defined in claim 11, and further comprising the step of:

comparing the ticket identifier read from the next ticket with the ticket identifier from the corresponding ticket record obtained from the electronic memory module to validate the ticket.

14. A method as defined in claim 13, and further comprising the step of: erasing from the electronic memory module the ticket record corresponding to the next ticket when the next ticket is dispensed.

* * * * *